US005691728A

United States Patent [19]

Goetz et al.

[11] Patent Number: 5,691,728

[45] Date of Patent: Nov. 25, 1997

[54] METHOD AND APPARATUS FOR BIAS ERROR REDUCTIOON IN AN N-PORT MODEFORMER OF THE BUTLER MATRIX TYPE

[75] Inventors: Allan Charles Goetz, La Jolla; Robert Gene Riddle, II, San Diego, both of Calif.

[73] Assignee: TRW Inc., Redondo Beach, Calif.

[21] Appl. No.: 621,853

[22] Filed: Mar. 25, 1996

[51] Int. Cl.[6] ..... H01Q 3/22; H01Q 3/24; H01Q 3/26

[52] U.S. Cl. ..... 342/373

[58] Field of Search ..... 342/373

[56] References Cited

U.S. PATENT DOCUMENTS

| | | | |
|---|---|---|---|
| 4,203,114 | 5/1980 | Gerst et al. . | |
| 4,228,436 | 10/1980 | DuFort . | |
| 4,366,483 | 12/1982 | Hagedon et al. | 343/113 |
| 4,431,995 | 2/1984 | Barton et al. | 343/373 |
| 4,489,322 | 12/1984 | Zulch et al. | 343/17.7 |
| 4,513,383 | 4/1985 | Hackett, Jr. | 364/517 |
| 4,630,064 | 12/1986 | Andrews et al. | 343/895 |
| 4,965,732 | 10/1990 | Roy, III et al. | 364/460 |
| 5,021,796 | 6/1991 | Corzine et al. | 343/712 |
| 5,065,162 | 11/1991 | Akaba et al. | 342/417 |
| 5,214,745 | 5/1993 | Sutherland | 395/22 |
| 5,253,192 | 10/1993 | Tufts | 364/726 |
| 5,293,114 | 3/1994 | McCormick et al. | 324/76.22 |
| 5,315,307 | 5/1994 | Tsui et al. | 342/444 |
| 5,327,213 | 7/1994 | Blake et al. | 356/350 |
| 5,373,299 | 12/1994 | Ozaki et al. | 342/373 |
| 5,381,150 | 1/1995 | Hawkins et al. | 342/13 |
| 5,390,258 | 2/1995 | Levin | 382/6 |
| 5,410,621 | 4/1995 | Hyatt | 382/69 |

*Primary Examiner*—Theodore M. Blum
*Attorney, Agent, or Firm*—Michael S. Yatsko

[57] ABSTRACT

A technique for compensating for bias errors that are inevitably introduced in an N-port analog modeformer (14) of the Butler matrix type, used to transform antenna arm signals obtained from a cylindrically symmetrical or spiral antenna (10), to an equal number of more useful mode signals. Corrupted mode signals from the analog modeformer (14) are downshifted in frequency in a coherent receiver processor (18), converted to digital corrupted mode signals in an analog-to-digital converter (22), and then further processed in a bias error reduction processor (26) to produce output signals that are a close approximation of true, uncorrupted mode signals. The bias error reduction processor 26 uses a memory (28) to store matrix quantities obtained from measurements previously made of the analog modeformer (14), and performs an error reduction function by simple matrix manipulations of the digital corrupted mode signals and the matrix quantities stored in the memory (28). The processor (26) may perform the matrix manipulations by calculation or may make use of a look-up table for faster processing.

7 Claims, 4 Drawing Sheets

IDEAL S MODE 0

IDEAL S MODE 1

IDEAL S MODE 2

IDEAL S MODE 3

IDEAL S MODE 4

IDEAL S MODE 5

IDEAL S MODE 6

IDEAL S MODE 7

METHOD AND APPARATUS FOR BIAS ERROR REDUCTIOON IN AN N-PORT MODEFORMER OF THE BUTLER MATRIX TYPE

BACKGROUND OF THE INVENTION

This invention relates generally to signal processing and, more particularly, to techniques for error reduction in a microwave antenna modeformer of the Butler matrix type. Multi-port analog modeformers are widely used in microwave antenna feed systems to convert signals from N ports of an antenna to M receive/transmit ports used to carry separate information signals or to determine the direction of a received signal. The voltages from antenna systems that have N-fold cylindrical symmetry about some axis produce particularly simple and useful analytic signals (or modes) when they are processed by an N-port modeformer using weights that make use of the N-fold symmetry. In the example given in this specification, N and M are equal, and the modeformer performs the function of converting the multiple antenna port signals, or "arm" signals, into an equal number of "mode" signals used for direction finding and other purposes.

The design goal of an analog modeformer is to provide a set of complex weights in a matrix, referred to as the F matrix, that is multiplied by the N analytic antenna arm signals to provide the desired N mode signals. Thus the basic operation of the modeformer can be represented as a simple matrix multiplication:

$$(\text{mode signals})=F*(\text{arm signals}), \tag{1}$$

where F is an N×N complex matrix, the elements of which are given by:

$$(F_{mn})=\frac{1}{\sqrt{N}}\,e^{im*n*\frac{2\pi}{N}}.$$

The F matrix is sometimes called the Fourier matrix, and the mode signals and arm signals are each (N×1) column vectors with complex elements. Analog modeformers of the Butler matrix type typically include a number of 90° or 180° hybrid couplers along with a number of fixed phase shifters, which are usually electronically interconnected via phase-trimmed coaxial cables. Because modeformers must operate at microwave frequencies, it is not practical to convert the received signals to digital form, and then implement the required conversion matrix as a digital processor. However, the components of an analog modeformer necessarily introduce bias errors into the conversion process, especially if the modeformer must operate over a wide frequency range. The bias errors in the modeformer cause the modeforming weights to deviate from the ideal (F matrix) weights, and the modes that are produced to differ from the ideal modes. The phase characteristics of the modes may not vary linearly with the azimuth angle and the amplitudes may not be constant when the antenna is rotated about its axis of symmetry. Moreover, the radio-frequency (rf) components of the modeformer have characteristics that vary with temperature, frequency and component aging. In this specification, the actual (corrupted) modeformer matrix will be referred to as the $\hat{F}$ matrix. The bias errors contained in $\hat{F}$ are characterized by weights that vary in amplitude and phase errors that are not fixed. A summary of the bias errors of a modeformer for a spiral antenna is given in a text by R. G. Corzine and J. A. Mosko, *Four-Arm Spiral Antennas,* published by Artech House (1990). However, prior to the present invention, there has been no known discussion of a consistent procedure for correcting these errors, and no technique for effecting such corrections was known to exist.

It will be appreciated from the foregoing that there is a need for improvement in modeforming techniques used to process the signals from multi-port antennas. Specifically, what is needed is a method to reliably correct for bias errors introduced by analog modeformers. The present invention satisfies this need.

SUMMARY OF THE INVENTION

The present invention resides in a bias error correction processor, and a corresponding method for its operation, for reducing the bias errors inherent in analog modeformers of the Butler matrix type used to process multi-port antenna signals. Briefly, and in general terms, the method of the invention comprises the steps of receiving a set of N antenna arm signals from a cylindrically symmetric antenna array, where N is an integral power of 2; transforming, in an analog modeformer of the Butler matrix type, the N antenna arm signals to N corrupted mode signals that contain bias errors introduced in the modeformer; and compensating for the bias errors in the mode signals to provide a more accurate mode forming transformation of the antenna signals.

More specifically, the compensating step includes converting the corrupted mode signals into digital form, and performing matrix manipulations to convert the corrupted mode signals to close approximations of true mode signals. These matrix manipulations may include computing a first approximation of the true mode signals by multiplying the corrupted mode signals by an inverted matrix, $Q^{-1}$, where $Q=\text{diag}(\hat{F}, F)$, and where $\hat{F}$ is the measured, corrupted, transformation matrix embodied in the analog modeformer and F is the known ideal transformation matrix. The parentheses indicate the inner product. The method may further include computing a correction signal to combine with the first approximation of the true mode signals, by multiplying the corrupted mode signals by the matrix $(D\cdot F^H\cdot Q^{-1})$, where $Q^{-1}$ has the same meaning as before, $F^H$ is the Hermitian conjugate of F, and D is given by the expression:

$$\sum_{n=1}^{N} \text{diag}(\hat{F}, F_n)\cdot F_n.$$

The diag ( ) operation produces a (N×N) diagonal matrix from a (N×1) column vector. In the disclosed embodiment of the invention, N=8, although it will be understood that N may be any other integral power of two, such as 4, 16 or 32.

The invention may also be expressed in terms of an N-port antenna system, comprising an antenna array having N ports producing as outputs N antenna arm signals, where N is an integral power of 2, an analog modeformer coupled to receive signals from the N antenna arm signals and including a network of the Buffer matrix type, to transform the N antenna arm signals to N mode signals that are more useful in processing data from the antenna array, wherein the analog modeformer inherently introduces bias errors into the mode signals and outputs a set of N corrupted mode signals; a coherent receiver processor for down-converting the corrupted mode signals to a lower frequency band; a set of analog-to-digital converters, for converting output signals from the coherent receiver to digital corrupted mode signals; and a bias error reduction processor, for reducing errors in the digital corrupted mode signals and generating a close approximation of true mode signals without significant bias errors.

More specifically, the bias error reduction processor includes means for computing a first approximation of the true mode signals by multiplying the corrupted mode signals by an inverted matrix $Q^{-1}(I-DF^{H}Q^{-1})$, where $Q=\mathrm{diag}(\hat{F},F)$, and where $\hat{F}$ is the measured, corrupted, transformation matrix embodied in the analog modeformer and F is the known ideal transformation matrix; and a memory for storing a previously measured matrix quantity Q for use by the means for computing the first approximation of the true mode signals. $F^{H}$ is the Hermitian conjugate of F, and D is given by $$\sum_{n=1}^{N} \mathrm{diag}(\hat{F}, F_n)\cdot F_n.$$

I is the identity matrix.

It will be appreciated from the foregoing that the present invention represents a significant advance in the field of antenna signal processing, and specifically in the field of modeformers. Because the invention provides for the correction of bias errors inherent in the operation of analog modeformers, these devices can be manufactured less expensively without regard to minimizing inherent bias errors. Moreover, the accuracy of angle-of-arrival measurements derived from antenna arrays is improved by a significant factor by using the present invention. Other aspects and advantages of the invention will become apparent from the following more detailed description, taken in conjunction with the accompanying drawings.

DESCRIPTION OF THE PREFERRED EMBODIMENT

Figure 1:
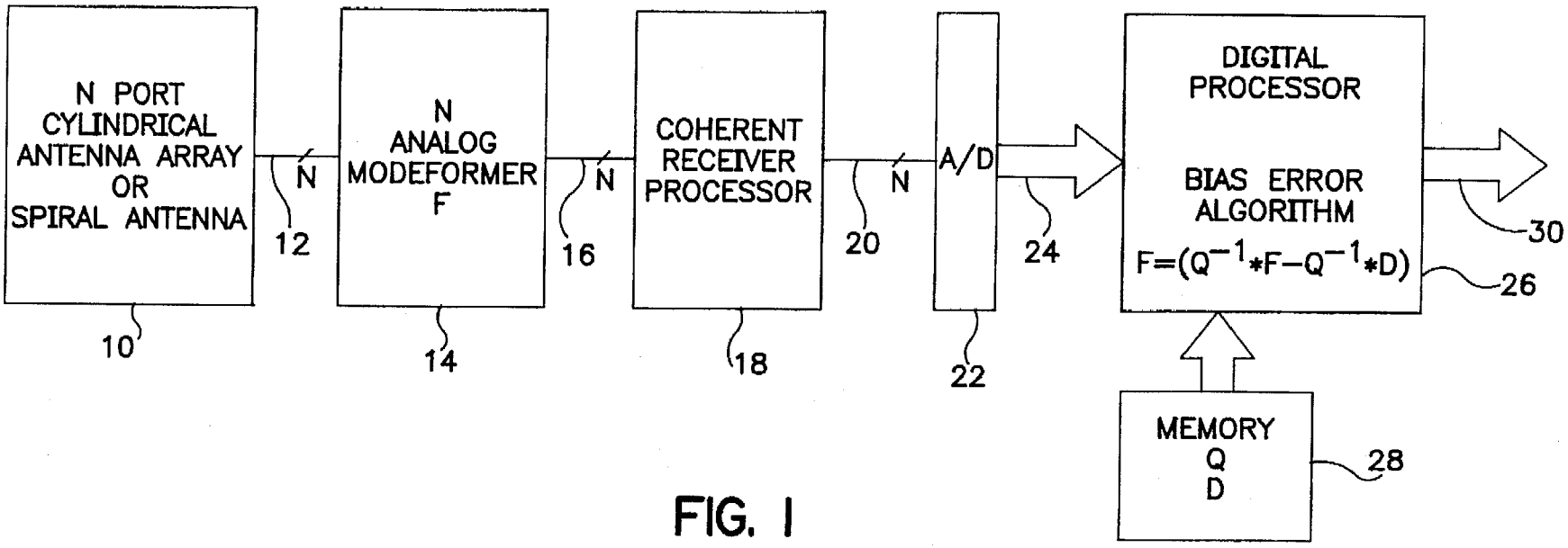
FIG. 1 is a block diagram of an N-port antenna system employing the bias error reduction technique of the present invention.
Figure 2A:
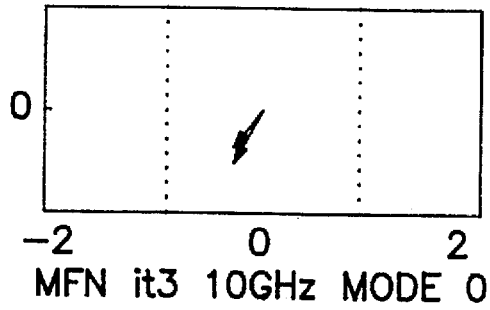
FIGS. 2A–2H are phasor diagrams showing measured complex mode weights of an eight-port modeformer transformation matrix.
Figure 2B:
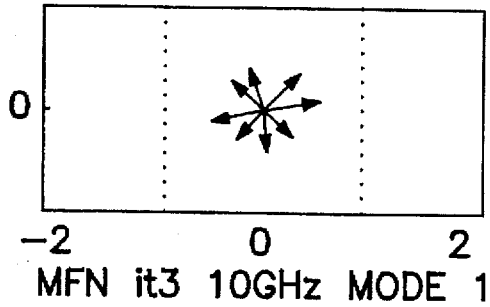
Figure 2C:
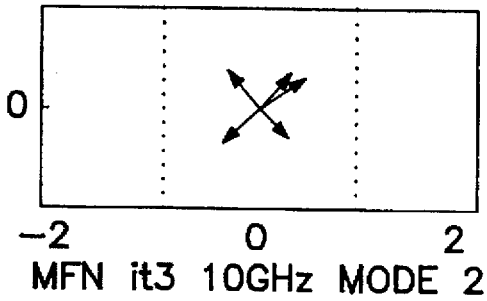
Figure 2D:
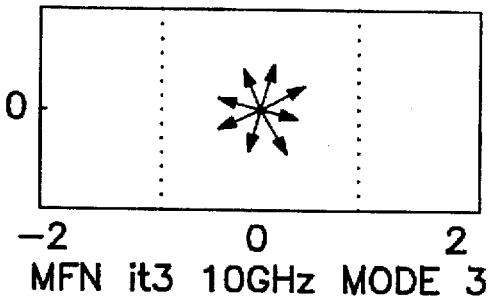
Figure 2E:
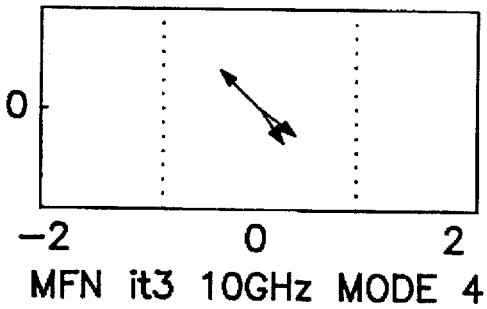
Figure 2F:
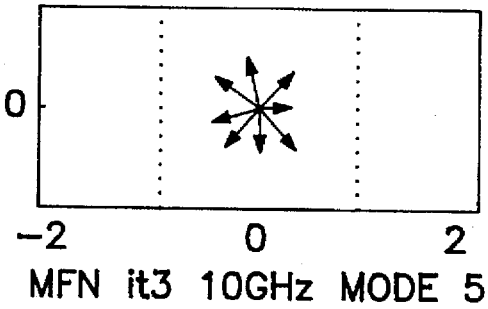
Figure 2G:
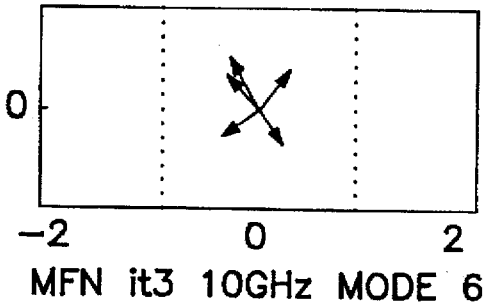
Figure 2H:
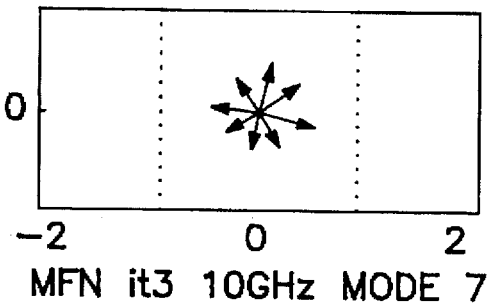

As shown in the drawings for purposes of illustration, the present invention pertains to a technique for reducing errors that are inherent in operation of a multi-port analog modeformer at microwave radio frequencies. As shown in FIG. 1, an N-port cylindrical antenna array or spiral antenna, indicated by reference numeral 10, produces a set of N output signals, referred to as arm signals, on line 12. The arm signals are input to an N×N analog modeformer 14, the function of which is to transform the arm signals into a set of N mode signals, on line 16. The analog modeformer 14 may be any modeformer of the Butler matrix type. For example, the modeformer described in U.S. Pat. No. 5,373,299 to Ozaki et al. may be used. The transformation performed in the modeformer 14 is simply a matrix multiplication in accordance with the expression:

$$(\text{mode signals})=F^{*}(\text{arm signals}), \quad (1)$$

where F is an N×N complex matrix, the elements of which are given by:

$$(F_{mn})=\frac{1}{\sqrt{N}}\, e^{im*n*\frac{2\pi}{N}}.$$

However, because of bias errors introduced in the modeformer 14, the ideal F matrix is distorted to a corrupt matrix $\hat{F}$ and the mode signals on line 16 are given by:

$$\hat{F}^{*}(\text{arm signals}).$$

Figure 3A:
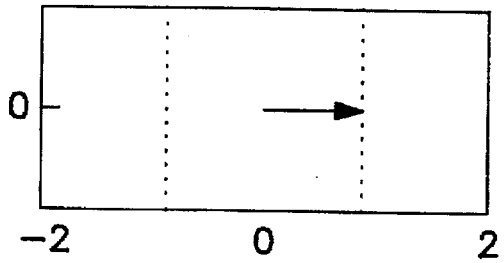
FIGS. 3A–3H are ideal mode weights corresponding to the measured weights of FIGS. 2A–2H, respectively.
Figure 3B:
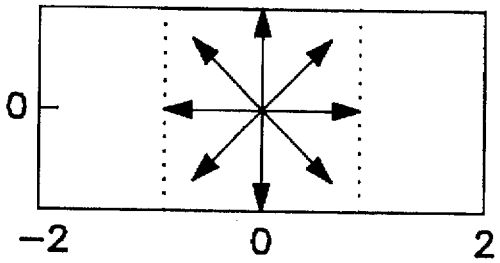
Figure 3C:
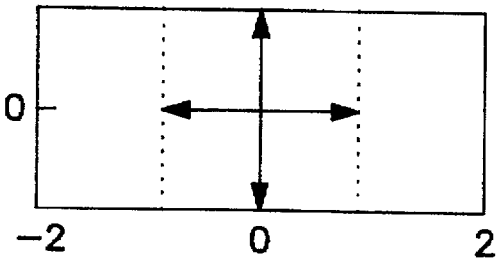
Figure 3D:
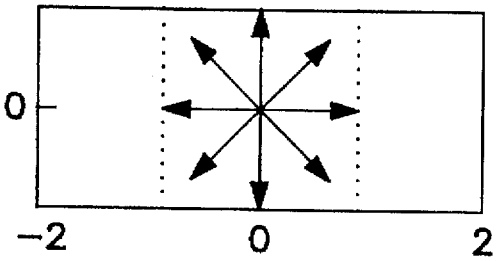
Figure 3E:
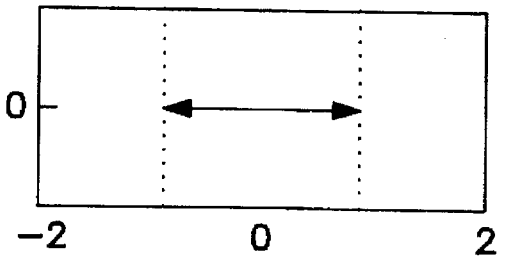
Figure 3F:
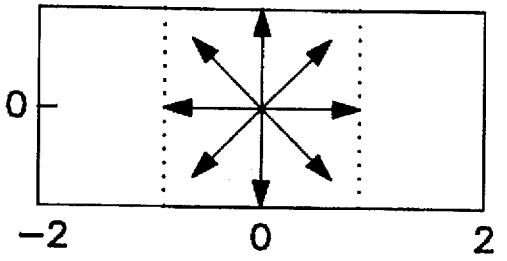
Figure 3G:
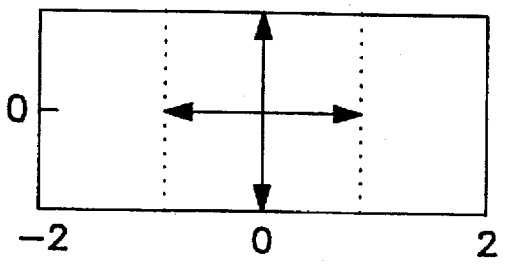
Figure 3H:
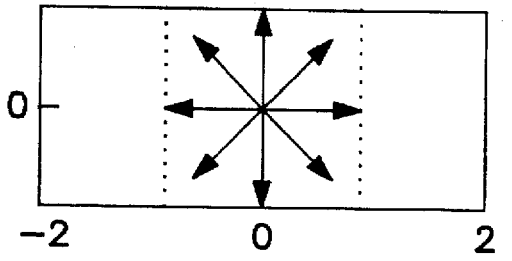

FIGS. 2A–2H depict eight sets of eight phasors that represent the complex weighting elements of the $\hat{F}$ matrix in a real 8×8 modeformer. FIGS. 3A–3H show the ideal mode weights, i.e. from the F matrix, for the corresponding eight modes. It will be noted that there are both phase and amplitude errors in the actual measured mode weights. For example, for mode 0 all eight ideal phasors are aligned, as shown in FIG. 3A, but in the measured weights, shown in FIG. 2A, the phasors are almost aligned, but in a completely different direction. Similar phase and amplitude differences can be observed in the other corresponding figures.

In accordance with the invention, the corrupted mode signals on line 16 are first down-converted to a lower frequency, in a coherent receiver processor 18, then coupled via lines 20 to a bank of analog-to-digital converters 22, which produce digital mode signals on line 24, but the digital mode signals are still corrupted by the errors introduced in the analog modeformer 14. The digital corrupted mode signals on line 14 are input to a bias error reduction processor 26, which uses values stored in an associated memory 28, and produces corrected mode signals on output line 30 that are very close to the true modes given by the ideal expression F*(arm signals).

The key to operation of the bias error reduction processor 26 is found in a principle involving matrix manipulations, a defined inner product, and a theory of an inner product space known as Hilbert Space. The text by Halmos, P. R., entitled *Introduction to Hilbert Space and the Theory of Spectral Multiplicity,* Chelsea Pub. Co. (1957) provides a good explanation of the theory of Hilbert Space.

First, if there are two matrices X and Y, which can be considered to be composed of N (=8) row vectors, such that:

$$X=(x_0x_1x_2x_3x_4x_5x_6x_7)^T$$

and $$Y=(y_0y_1y_2y_3y_4y_5y_6y_7)^T$$

then the inner product (X,Y) is defined as:

$$(X,Y)=(y_0{}^{*}x_0{}^{H}\ y_1{}^{*}x_1{}^{H}\ \ldots\ y_7{}^{*}x_7{}^{H})^T,$$

where the superscript H indicates the Hermitian transpose and the * symbol implies a conventional multiplicative vector inner product. Two matrices therefore produce a 1×N column vector as their inner product.

Next, a set of basis matrices and the defined inner product are used to define a Hilbert space, which, like a metric space, is complete. The basic approach for use in the error reduction processor is to expand the corrupted modeforming matrix $\hat{F}$ in terms of a complete set of basis matrices, $\{F_n\}$, of which the ideal matrix F is one member. The expansion of the $\hat{F}$ matrix in terms of the basis set of constant matrices provides an expression for the small bias errors present:

$$\hat{F} = \sum_{n=0}^{7} \mathrm{diag}(\hat{F}, F_n) \cdot F_n = \mathrm{diag}(\hat{F}, F_0) \cdot F_0 + \sum_{n=1}^{7} \mathrm{diag}(\hat{F}, F_n) \cdot F_n, \quad (2)$$

where diag places a column vector on the diagonal of an N×N matrix, and $F_0$ is the same as the ideal matrix F. Because $\hat{F}$ differs only slightly from F, the last seven terms of this expansion (n=1 through 7) will be relatively small.

Equation (2) may be alternatively expressed as:

$$\hat{F} = Q \cdot F + D, \quad (3)$$

$$\text{where } Q = \mathrm{diag}(\hat{F}, F_0) \text{ and } D = \sum_{n=1}^{7} \mathrm{diag}(\hat{F}, F_n) \cdot F_n.$$

Because D has elements that are relatively small, equation (3) can be rewritten, to the first order of approximation, as:

$$Q^{-1} \cdot \hat{F} \approx F \text{ and } D \approx DF^H Q^{-1} \hat{F}. \quad (4)$$

The "true" modes that are not corrupted by bias errors can be expressed as:

$$\text{true modes} = F \cdot \text{arm} = Q^{-1} \cdot (\hat{F} \cdot \text{arm}) - Q^{-1}(D \cdot F^H \cdot Q^{-1}) \cdot (\hat{F} \cdot \text{arm}) \quad (5)$$

The signals that appear at the modeformer outputs (on line 16) are given by the column vector $\hat{F}$·arm. Equation (5) therefore provides an accurate means of generating the uncorrupted modes from the corrupted ones. Written in another way it provides a means of approximating the uncorrupted matrix as:

$$F = Q^{-1} \cdot \hat{F} - Q^{-1}(D \cdot F^H \cdot Q^{-1}) \cdot \hat{F}, \quad (6)$$

where $F^H$ is the Hermitian conjugate of F.

Equation (5) represents the function performed in the bias error reduction processor 26. The corrupted modes input on lines 24 may be expressed as $\hat{F}$·arm, and the true modes output on line 30 are F·arm, as expressed in the equation. The Q and D matrices are determined for a specific antenna and are stored in some convenient form in the memory 28 prior to operation of the antenna system. Since Q and D are constant matrices, at least if variables such as frequency are relatively constant, the computation of equation (5) may best be performed by a table look-up process, wherein the memory contains precomputed values for the two terms of the equation corresponding to various values of the corrupted arm signals. Linear interpolation may be employed to obtain intermediate values of the two terms. Different look-up tables may be provided for different frequency bands, for improved accuracy. Alternatively, the computation defined by equation (5) may be performed in real time instead of by table look-up and interpolation.

Figure 4A:
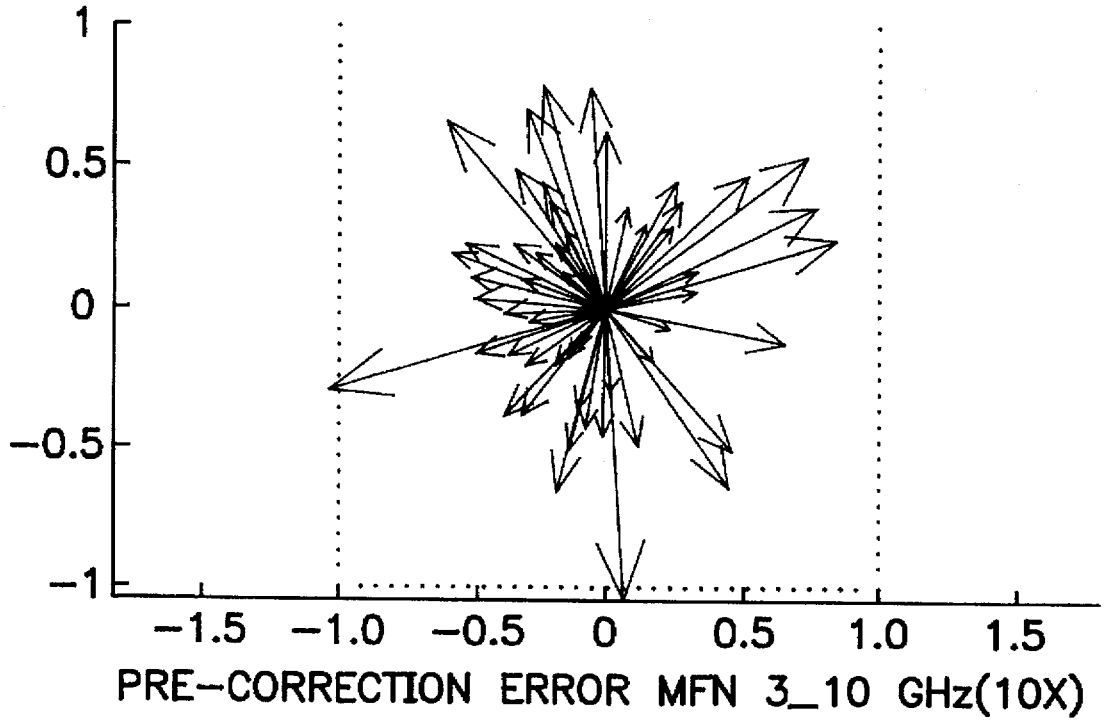
FIG. 4A is a composite phasor diagram showing all sixty-four mode weight phasors as measured in an eight-port modeformer.
Figure 4B:
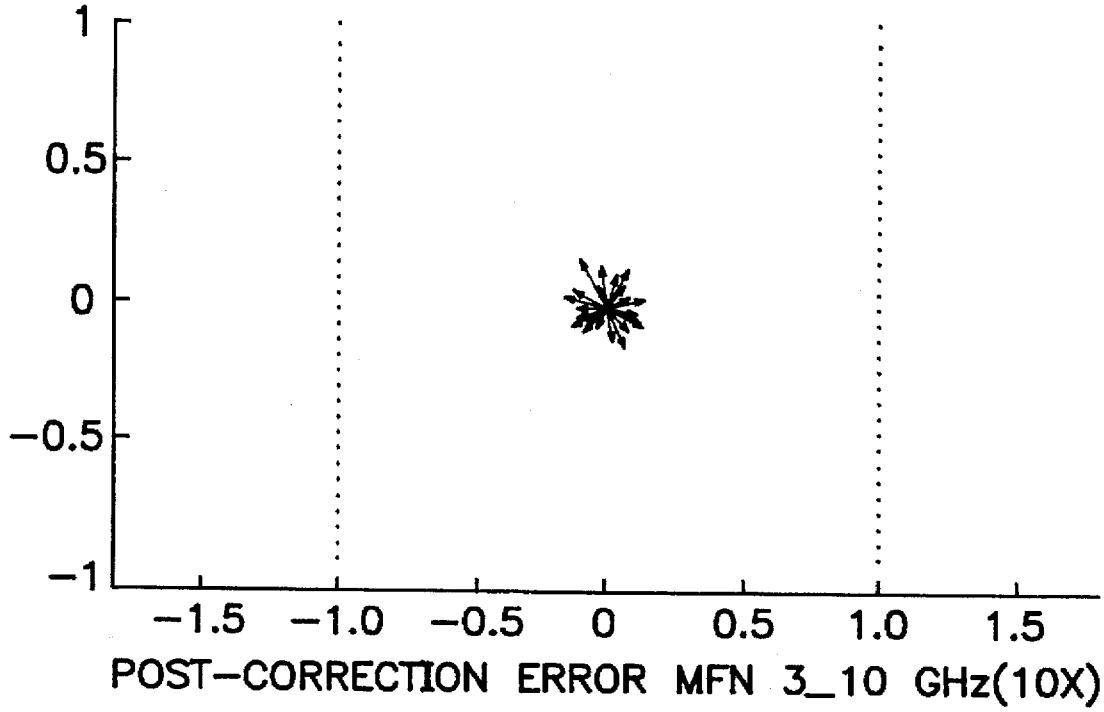
FIG. 4B is a composite phasor diagram similar to FIG. 4A, but showing the sixty-four phasors after correction by the method and apparatus of the present invention.

FIG. 4A shows the differential errors in all sixty-four phasors associated with an uncorrected modeformer, and is basically a composite depiction of the differential errors in all the phasors shown in FIGS. 2A–2H. For comparison, FIG. 4B shows the differential phasor errors after error reduction in the processor 26. This dramatic reduction in the magnitude of the differential phasor errors results in an equally dramatic improvement in performance characteristics. When the antenna system is used for wide field angle of arrival (AOA) measurement, for example, the results can be as much as ten times more accurate than those based on uncorrected modeformer signals.

The principle of the invention has application wherever highly accurate single aperture/antenna systems are used. The antenna systems may be any cylindrically symmetric design, including arrays of dipole, slot, or patch antenna elements, or may be an N-arm spiral antenna. The invention can be applied in both the military and commercial fields. In military electronic warfare and intelligence gathering using single aperture angle-of-arrival systems, the invention provides for increased accuracy and cost savings relative to linear interferometer systems. The invention may also be applied to an accurate tactical collision avoidance system that requires a wide field of view. With use of the invention, modeformer manufacturing tolerances can be relaxed without loss of AOA accuracy, since the modeformer errors can now be easily corrected. Therefore, the overall antenna system incorporating error reduction in accordance with the invention enjoys a considerable manufacturing cost advantage.

It will be appreciated from the foregoing that the present invention represents a significant advance in the field of multi-port antenna systems. In particular, the invention provides accurate correction of bias errors introduced in an analog modeformer, allowing modeformers to be manufactured with less stringent manufacturing tolerances, and providing for greatly increased accuracy in angle-of-arrival measurements obtained from antenna systems. It will also be appreciated that, although a specific embodiment of the invention has been disclosed for purposes of illustration, various modifications may be made without departing from spirit and scope of the invention. Accordingly, the invention should not be limited except as by the appended claims.

We claim:

1. A method for reducing errors introduced in an analog modeformer of the Butler matrix type, the method comprising the steps of:

receiving a set of N antenna arm signals from a cylindrically symmetric antenna array, where N is an integral power of 2;

transforming, in an analog modeformer of the Butler matrix type, the N antenna arm signals to N corrupted mode signals that contain bias errors introduced in the modeformer; and compensating for the bias errors in the mode signals to provide a more accurate mode forming transformation of the antenna signals.

2. A method as defined in claim 1, wherein the compensating step includes:

converting the mode signals that contain bias errors into digital form; and performing matrix manipulations to convert the corrupted mode signals to corrected mode signals that are approximately equivalent to true mode signals.

3. A method as defined in claim 2, wherein the step of performing matrix manipulations includes:

computing a first approximation of the true mode signals by multiplying the corrupted mode signals by an inverted matrix $Q^{-1}(I-DF^HQ^{-1})$, where $Q=\mathrm{diag}(\hat{F}, F)$, where $\hat{F}$ is the measured, corrupted, transformation matrix embodied in the analog modeformer, F is the known ideal transformation matrix, , $F^H$ is the Hermitian conjugate of F, D is given by $$\sum_{n=1}^{N} \mathrm{diag}(\hat{F}, F_n) \cdot F_n,$$

and I is the identity matrix.

4. A method as defined in claim 3, wherein N=8.

5. An N-port antenna system, comprising:

an antenna array having N ports, where N is an integral power of 2, producing as outputs N antenna arm signals;

an analog modeformer coupled to receive signals from the N antenna arm signals and including a network of the Butler matrix type, to transform the N antenna arm signals to N mode signals used for processing data from the antenna array, wherein the analog modeformer inherently introduces bias errors into the mode signals and outputs a set of N corrupted mode signals;

a coherent receiver processor for down-converting the corrupted mode signals to a lower frequency band;

a set of analog-to-digital converters, for converting output signals from the coherent receiver to digital corrupted mode signals; and a bias error reduction processor, for reducing errors in the digital corrupted mode signals and generating corrected mode signals that are approximately equivalent to true mode signals without significant bias errors.

6. An N-port antenna system as defined in claim 5, wherein the bias error reduction processor includes:

means for computing a first approximation of the true mode signals by multiplying the corrupted mode signals by an inverted matrix $Q^{-1}(I-DF^{H}Q^{-1})$, where $Q=\mathrm{diag}(\hat{F},F)$, and where $\hat{F}$ is the measured, corrupted, transformation matrix embodied in the analog modeformer, F is the known ideal transformation matrix, $F^{H}$ is the Hermitian conjugate of F, I is the identity matrix and D is given by $$\sum_{n=1}^{N} \mathrm{diag}(\hat{F}, F_n) \cdot F_{n\cdot};$$

and a memory for storing a previously measured Q for use by the means for computing the first approximation of the true mode signals.

7. An N-port antenna system as defined in claim 6, wherein N=8.

* * * * *